US008287234B1

(12) United States Patent
Liang

(10) Patent No.: US 8,287,234 B1
(45) Date of Patent: Oct. 16, 2012

(54) TURBINE INTER-SEGMENT MATE-FACE COOLING DESIGN

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 658 days.

(21) Appl. No.: 12/544,670

(22) Filed: Aug. 20, 2009

(51) Int. Cl.
*F01D 11/08* (2006.01)

(52) U.S. Cl. ..... 415/173.1; 415/139; 416/191

(58) Field of Classification Search ..... 415/134, 415/139, 170.1, 173.1; 416/191, 192, 193 A
See application file for complete search history.

(56) References Cited

U.S. PATENT DOCUMENTS 5,374,161 A * 12/1994 Kelch et al. ..... 415/139
6,491,093 B2 * 12/2002 Kreis et al. ..... 165/169
6,554,566 B1 * 4/2003 Nigmatulin ..... 415/139
7,334,985 B2 * 2/2008 Lutjen et al. ..... 415/173.1
2006/0140762 A1 * 6/2006 Pietraszkiewicz et al. . 416/97 R
2008/0118346 A1 * 5/2008 Liang ..... 415/115
2009/0155054 A1 * 6/2009 Rathmann ..... 415/134

* cited by examiner

*Primary Examiner* — Richard Edgar
*Assistant Examiner* — Ryan Ellis
(74) *Attorney, Agent, or Firm* — John Ryznic

(57) ABSTRACT

A blade outer air seal segment assembly for a turbine in which adjacent segments form a curved metering and diffusion cooling slot for the discharge of film cooling air onto an inner surface of the segments. The segments include a first diffusion cavity connected to the backside surfaces of the segments through metering holes. The curved slot is connected to the first diffusion cavity. spend cooling air for cooling of the backside surfaces of the segments is metered into the first diffusion cavity and then discharged as film cooling air from the curved slot in a direction of rotation of the rotor blades to provide both sealing and cooling for the mate face of the segments.

9 Claims, 2 Drawing Sheets

View A-A
Prior Art

View B-B

TURBINE INTER-SEGMENT MATE-FACE COOLING DESIGN

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a cooling circuit for an industrial gas turbine blade outer air seal inter-segment gap.

2. Description of the Related Art Including Information Disclosed Under 37 CFR 1.97 and 1.98

A gas turbine engine includes a turbine with multiple rows or stages of rotor blades with stator vanes located upstream to guide a hot gas flow through the rotor blades. The rows of rotor blades rotate within an outer shroud that forms a blade outer air seal (BOAS) with a small gap or blade tip clearance to minimize leakage across the blade tips. In an industrial gas turbine engine, the outer shroud is formed from an annular arrangement of shroud segments each with relatively large gaps between adjacent segments to allow for metal expansion during operation and transients of the engine. These shroud segments are loose fitting at cold temperature and thermally expand at steady state temperature to close the gaps.

In order to limit leakage across the segment gaps, axial slots are formed in the segment mate faces in which a seal is placed. FIG. 1 shows a prior art blade outer air seal design with two adjacent shroud segments having axial slots facing each other and with a flat seal secured within the adjacent slots. Cooling air holes are formed along the lower surface of the shroud segments to pass cooling air and provide some cooling to the segments. FIG. 2 shows a close-up view of the mate face of two shroud segments with the axial gap and the seal within the slots. The FIGS. 1 and 2 BOAS design lacks adequate cooling and sealing to prevent hot gas ingestion along the axial slot. Hot gas flows in and out along the inter-segment gaps and creates an over-temperature at the BOAS edges corresponding to the hot gas injection location.

BRIEF SUMMARY OF THE INVENTION

It is an object of the present invention to provide for a turbine inter-segment mate face with improved cooling and sealing over the cited prior art reference.

It is another object of the present invention to provide for a turbine inter-segment mate face cooling and sealing design that will prevent an over-temperature of the BOAS edges.

The above objectives and more are achieved with the turbine inter-segment mate face cooling circuit of the present invention in which the BOAS edges are cooled using a metering and diffusion curved slot that is connected to a diffusion cavity formed between the mate faces and supplied with cooling air from the backside surface of the BOAS. The metering and diffusion slots are curved in a direction of the rotor blade rotation so that the cooling air discharged from the curved slots will flow into the hot gas flow path to provide film cooling for the BOAS edge. The curved metering and diffusion slot is formed with curved ribs that form a series of small slots that function as cooling flow diffusion slots to improve the inter-segment cooling capability. The series of local ribs will also partition the inter-segment gap to minimize the hot gas flow in and out along the inter-segment gap and prevent inter-segment over-temperature.

DETAILED DESCRIPTION OF THE INVENTION

Figure 1:
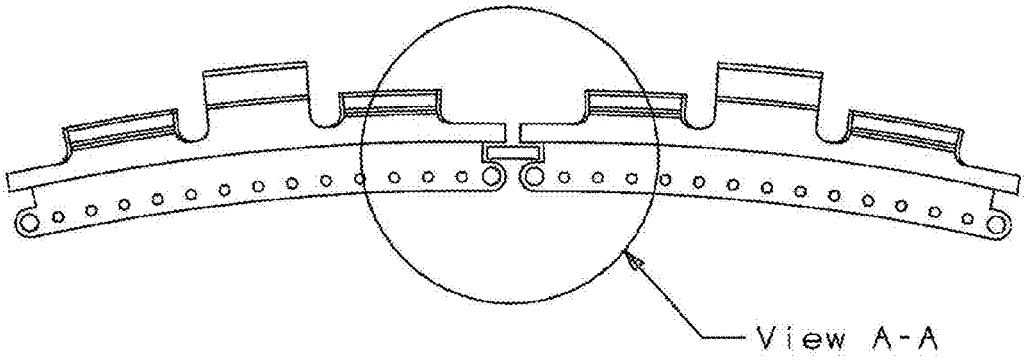
Fig 1 Prior Art
FIG. 1 shows a front view of a prior art blade outer air seal segment design.
Figure 2:
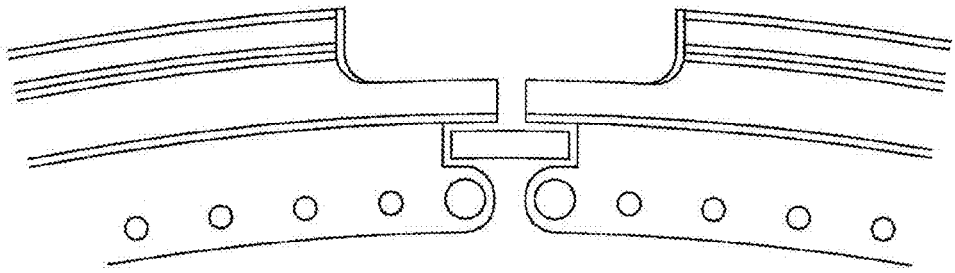
FIG. 2 shows a close-up view of two adjacent BOAS segments with a seal in the axial gap.
Figure 3:
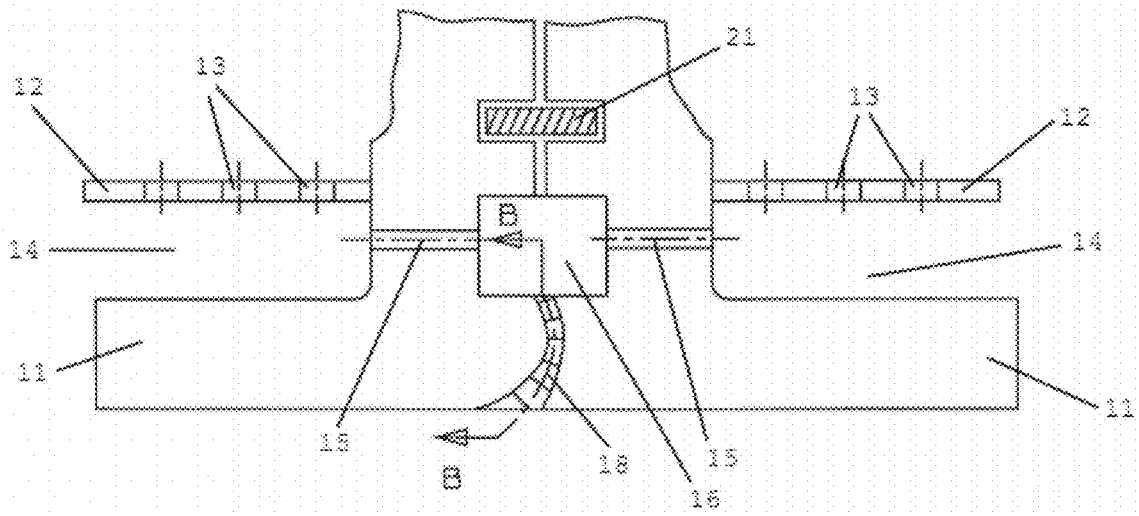
FIG. 3 shows a cross section front view of the BOAS edge cooling and sealing design of the present invention.

The cooling and sealing design for the BOAS of the present invention is shown in FIG. 3. The BOAS is formed by segments 11 that have an inner surface that forms the gap with the blade tips. The segments include upper or backside surfaces that are cooled by passing impingement cooling air through holes 13 formed in impingement plates 12. The cooling air passing through the holes 13 to provide impingement cooling of the backside of the segments 11. The spent cooling air from the backside cavity 14 then passes through metering holes 15 formed in the segments 11 and into a diffusion cavity 16 formed between adjacent segments 11. The metering holes that open into the first diffusion cavity 16 are offset or staggered so that the metering holes 15 on the left side are offset from the metering holes on the right side of the cavity 16. This promotes better cooling of the cavity 16. A seal 21 is placed in slots formed with the tip rails of each segment 11 to seal a gap formed between adjacent segments 11. The cooling air passed into the first diffusion cavity 16 is also used to impinged onto the rail of an adjacent BOAS to provide cooling to this rail.

A curved metering and diffusion slot 18 is formed by the adjacent segments 11 when placed in position to form the BOAS. The curved slots 18 connect the diffusion cavity 16 to the inner surface of the shroud segments 11 and curve in a direction of rotation of the rotor blade movement. In FIG. 3, the rotor blades would rotate from right to left. The curved slot 18 extends along most of the axial length of the segments 11 in which the axial direction would be perpendicular to the page in FIG. 3. The axial direction of the segments is along a line parallel to the axis of the turbine.

Figure 4:
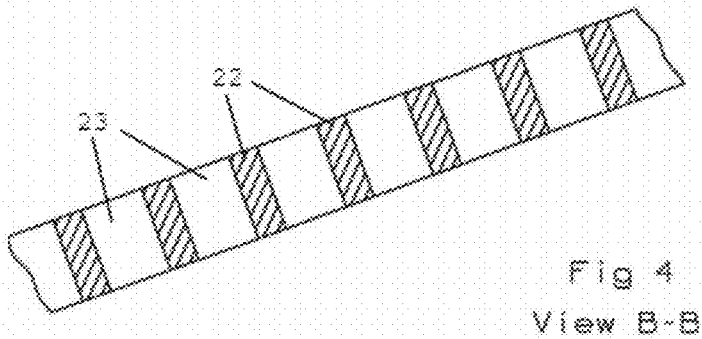
FIG. 4 shows a cross section view of the curved diffusion and metering clot through line B-B of FIG. 3.
Figure 5:
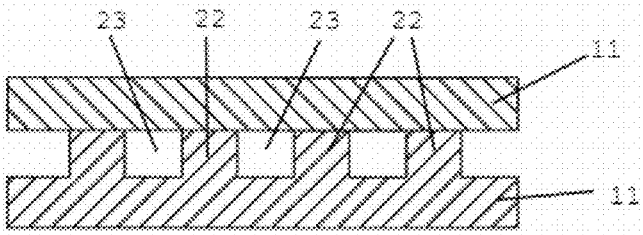
FIG. 5 shows a view of the small slots formed by the series of local ribs that form the curved slot of the present invention.

The curved slots are both metering and diffusion slots in which an inlet section of the curved slot forms a metering portion to meter the amount of cooling air passing through the curved slot. Downstream from the metering section is the diffusion section that progressively increases in cross sectional area to decrease the velocity of the cooling air while increasing the pressure of the cooling air before discharging out through the opening of the slot. The curved slot 18 is formed with a series of local and axially spaced ribs 22 that are built in on the side of the BOAS. The series of local ribs 22 can also be formed within both sides of the BOAS depending upon the assembly procedure. FIG. 4 shows adjacent local ribs 22 on one of the segments 11. The spacing of the ribs 22 forms the small slots 23. FIG. 5 shows one embodiment in which one of the segments includes the local ribs 22 that extend out from the segment to form the small slots 22. When the ribs abut against the adjacent segment 11, the small slots are enclosed and formed between the two segments. In another embodiment, the ribs can extend from both segments in an alternating manner or in any design that will still function to form the metering and diffusion slots 18. The ribs 22 form a series of small slots 23 that function as cooling flow metering and diffusion slots to improve the inter-segment cooling. Also, the series of local ribs 22 will partition the inter-segment gap to minimize a hot gas flow in and out along the inter-segment gap and prevent inter-segment over-temperature. The seal 21, the first diffusion cavity 16 and the curved slot 18 have about the same axial length in the segments.

In operation, cooling air impinges on the backside of the BOAS to provide cooling for the segments. The spent cooling air is then discharged along the BOAS peripheral holes for cooling of the rails. A portion of the cooling air is used for the inter-segment rail cooling and is bled through the metering holes 15 and into the first diffusion cavity 16 in an offset or staggered arrangement to improve cooling of the cavity 16. The spent cooling air is then discharged through the curved diffusion slots 18 formed by the local ribs 22. Some of the cooling air in the first diffusion cavity is used to cool the rail of the adjacent BOAS. The cooling air is then discharged into the hot gas flow path to provide film cooling for the BOAS edge. The combination effects of metering and diffusion cooling with local film cooling produced with the present invention will provide for a very effective cooling arrangement for the BOAS inter-segments.

I claim:

1. A blade outer air seal segment assembly for a turbine comprising:

a first and second blade outer air seal segment each having a backside surface and a tip rail extending outward;

a gap formed between the two segments;

a first diffusion cavity formed in the rails of the segments;

an axial slot formed within the rails of the segments;

a seal secured within the axial slot;

a plurality of metering holes connecting the first diffusion cavity with the backside surface of one of the segments; and, a curved metering and diffusion slot formed between mate faces of the two segments, the curved metering and diffusion slot connected to the first diffusion cavity and opening onto an inner surface of the segments.

2. The blade outer air seal segment assembly of claim 1, and further comprising:

the curved metering and diffusion slot includes a metering section connected to the first diffusion cavity and a diffusion section that opens onto the inner surface of the segments.

3. The blade outer air seal segment assembly of claim 1, and further comprising:

the curved metering and diffusion slot is formed by a series of ribs extending from one or both of the segments that abut against the adjacent segment to enclose small slots formed by the ribs.

4. The blade outer air seal segment assembly of claim 1, and further comprising:

the first diffusion cavity is connected to both backside surfaces of the two segments through the plurality of metering holes.

5. The blade outer air seal segment assembly of claim 1, and further comprising:

the seal, the first diffusion cavity and the curved slot 18 have approximately the same axial length in the segments.

6. A process for cooling and sealing a blade outer air seal inter-segment of a turbine, comprising the steps of:

passing impingement cooling air to a backside surface of the BOAS;

passing the spent impingement cooling air along peripheral cooling holes to provide cooling for the blade outer air seal;

passing a portion of the spent impingement cooling air through a row of metering holes and into a diffusion cavity formed within rails of the segments;

metering the diffusing the cooling air from the diffusion cavity; and, discharging the metered and diffused cooling air onto an inner surface of the BOAS segments.

7. The process for cooling and sealing a blade outer air seal inter-segment of claim 6, and further comprising the step of:

discharging the metered and diffused cooling air onto an inner surface of the blade outer air seal segments in a direction of rotation of the rotor blades of the turbine.

8. The process for cooling and sealing a blade outer air seal inter-segment of claim 7, and further comprising the step of:

separating the metered and diffused cooling air within a curved slot into separate small curved slots.

9. The process for cooling and sealing a blade outer air seal inter-segment of claim 7, and further comprising the step of:

discharging a portion of the cooling air passed into the diffusion cavity to an adjacent blade outer air seal to cool the rail of the adjacent blade outer air seal.

* * * * *